US011118839B2

(12) United States Patent
Zhang et al.

(10) Patent No.: US 11,118,839 B2
(45) Date of Patent: Sep. 14, 2021

(54) HEAT EXCHANGE ASSEMBLY FOR HEAT EXCHANGER, HEAT EXCHANGER, AND MOLD

(71) Applicant: Danfoss Micro Channel Heat Exchanger (Jiaxing) Co., Ltd., Zhejiang (CN)

(72) Inventors: Feng Zhang, Zhejiang (CN); Xiangxun Lu, Zhejiang (CN); Pierre Olivier Pelletier, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 91 days.

(21) Appl. No.: 16/333,740

(22) PCT Filed: Sep. 27, 2017

(86) PCT No.: PCT/CN2017/103687
§ 371 (c)(1),
(2) Date: Mar. 15, 2019

(87) PCT Pub. No.: WO2018/059443
PCT Pub. Date: Apr. 5, 2018

(65) Prior Publication Data

US 2019/0360753 A1 Nov. 28, 2019

(30) Foreign Application Priority Data

Sep. 28, 2016 (CN) ..... 201610859225.1

(51) Int. Cl.
*F28D 1/03* (2006.01)
*B21C 25/02* (2006.01)
(Continued)

(52) U.S. Cl.
CPC ..... *F28D 1/0391* (2013.01); *B21C 25/02* (2013.01); *F28D 1/05341* (2013.01); *F28F 1/32* (2013.01);
(Continued)

(58) Field of Classification Search
CPC ..... F28D 1/0391
(Continued)

(56) References Cited

U.S. PATENT DOCUMENTS 5,494,099 A 2/1996 Chiba et al.
2003/0070751 A1 4/2003 Bergevin et al.
(Continued)

FOREIGN PATENT DOCUMENTS

CN 1981168 A 6/2007
CN 103574994 A 2/2014
(Continued)

OTHER PUBLICATIONS

International Search Report for Serial No. PCT/CN2017/103687 dated Jan. 4, 2018.
(Continued)

*Primary Examiner* — Henry T Crenshaw
(74) *Attorney, Agent, or Firm* — McCormick, Paulding & Huber PLLC

(57) ABSTRACT

A heat exchange assembly (1) for a heat exchanger, a heat exchanger comprising the heat exchange assembly (1), and a mold forming the heat exchange assembly (1) are provided. The heat exchange assembly (1) comprises: multiple heat exchange tubes (11) through which a heat exchange medium flows; a connecting plate (12) connected between adjacent heat exchange tubes (11); and a heat exchange plate (121) formed by at least one part of the connecting plate (12). The mold comprises: a first mold, the first mold forming holes (110) in the multiple heat exchange tubes
(Continued)

(11); and a second mold (2), the second mold having a mold cavity (20) forming a main body of the heat exchange assembly (1), the mold cavity (20) having an opening (21), the heat exchange assembly (1) being extruded from the opening (21) of the mold cavity (20) of the second mold (2), and the opening (21) being strip-shaped and extending along a curved line.

18 Claims, 16 Drawing Sheets

(51) Int. Cl.
*F28D 1/053* (2006.01)
*F28F 1/32* (2006.01)
*F28F 3/04* (2006.01)
*F28F 9/02* (2006.01)

(52) U.S. Cl.
CPC ..... *F28F 3/044* (2013.01); *F28F 9/0278* (2013.01); *F28F 2215/08* (2013.01)

(58) Field of Classification Search
USPC ..... 165/177
See application file for complete search history.

(56) References Cited

U.S. PATENT DOCUMENTS

| | | | | |
|---|---|---|---|---|
| 2004/0177948 | A1 | 9/2004 | Cho et al. | |
| 2004/0261986 | A1* | 12/2004 | Insalaco | F28F 9/0202 165/181 |
| 2011/0036553 | A1* | 2/2011 | Christen | F28F 19/006 165/185 |
| 2011/0180227 | A1 | 7/2011 | Anglin | |
| 2014/0034271 | A1* | 2/2014 | Lee | F28F 17/00 165/96 |
| 2019/0360753 | A1* | 11/2019 | Zhang | F28F 1/20 |

FOREIGN PATENT DOCUMENTS

| | | | |
|---|---|---|---|
| CN | 104677162 | A | 6/2015 |
| CN | 105371687 | A | 3/2016 |
| EP | 0097905 | A2 | 1/1984 |
| JP | H10166034 | A | 6/1998 |
| JP | 2007170718 | A | 7/2007 |

OTHER PUBLICATIONS

European Search Report for Serial No. EP 17854893.9 dated Mar. 30, 2020.

* cited by examiner

HEAT EXCHANGE ASSEMBLY FOR HEAT EXCHANGER, HEAT EXCHANGER, AND MOLD

CROSS-REFERENCE TO RELATED APPLICATION

This application is a National Stage application of International Patent Application No. PCT/CN2017/103687, filed on Sep. 27, 2017, which claims priority to Chinese Patent Application No. 201610859225.1, filed on Sep. 28, 2016, each of which is hereby incorporated by reference in its entirety.

TECHNICAL FIELD

The embodiments of the present invention relate to a heat exchange assembly for a heat exchanger, a heat exchanger comprising the heat exchange assembly, and a mold for forming the heat exchange assembly.

BACKGROUND

A heat exchanger generally comprises heat exchange tubes such as flat tubes, and corrugated fins disposed between the flat tubes.

SUMMARY

An object of the embodiments of the present invention is to provide a heat exchange assembly for a heat exchanger, a heat exchanger comprising the heat exchange assembly, and a mold for forming the heat exchange assembly, whereby, for example, product costs can be lowered.

An embodiment of the present invention provides a heat exchange assembly for a heat exchanger, the heat exchange assembly comprising: multiple heat exchange tubes for a heat exchange medium to flow through; a connecting plate connected between adjacent heat exchange tubes; and a heat exchange plate formed by at least a part of the connecting plate.

According to an embodiment of the present invention, the connecting plate comprises a main body, and the heat exchange plate which is not in the same plane as the main body.

According to an embodiment of the present invention, the heat exchange plate comprises a louver-like heat exchange plate.

According to an embodiment of the present invention, the heat exchange plate comprises a main body, and a bridge plate protruding from the main body to one side of the main body in a direction perpendicular to the main body, with a part of a periphery of the bridge plate being separate from the main body.

According to an embodiment of the present invention, a length direction of the heat exchange plate is substantially perpendicular to, or forms an acute angle with, an axial direction of the heat exchange tube.

According to an embodiment of the present invention, the multiple heat exchange tubes and the connecting plate are formed as a single body by extrusion molding.

According to an embodiment of the present invention, a heat exchanger is provided, comprising the abovementioned heat exchange assembly for a heat exchanger.

According to an embodiment of the present invention, the heat exchanger further comprises a header, the heat exchange assembly being at least one layer of the heat exchange assembly substantially parallel to an axial direction of the header.

According to an embodiment of the present invention, the heat exchange assembly is a multiple-layer heat exchange assembly formed by bending a single heat exchange assembly.

According to an embodiment of the present invention, the multiple-layer heat exchange assembly is formed by bending a single heat exchange assembly in a direction substantially parallel or perpendicular to an axial direction of the heat exchange tube.

According to an embodiment of the present invention, the heat exchange assembly is a multiple-layer heat exchange assembly, and ends of multiple heat exchange tubes in the multiple-layer heat exchange assembly are respectively inserted into different openings of a header.

According to an embodiment of the present invention, the heat exchange assembly has the shape of a polygonal line when viewed in a direction parallel to an axial direction of the heat exchange tube.

According to an embodiment of the present invention, the heat exchange assembly has a corrugated shape when viewed in a direction perpendicular to an axial direction of the heat exchange tube.

According to an embodiment of the present invention, the heat exchange assembly is a multiple-layer heat exchange assembly, and heat exchange tubes of at least two layers of the heat exchange assembly in the heat exchange assembly are staggered with respect to each other in a direction perpendicular to an axial direction of the heat exchange tubes.

According to an embodiment of the present invention, the heat exchange assembly is a multiple-layer heat exchange assembly, and ends of multiple heat exchange tubes in the multiple-layer heat exchange assembly, which are arranged in a direction substantially perpendicular to or forming an acute angle with an axial direction of a header, are inserted into the same opening of the header.

An embodiment of the present invention provides a mold for forming the abovementioned heat exchange assembly for a heat exchanger, the mold comprising: a first mold, being used to form holes of multiple heat exchange tubes; and a second mold, the second mold having a mold cavity for forming a main body of the heat exchange assembly, the mold cavity having an opening, and the heat exchange assembly being extruded from the opening of the mold cavity of the second mold, wherein the opening is belt-like, and extends along a curved line.

According to an embodiment of the present invention, the curved line is a non-closed line.

According to an embodiment of the present invention, the curved line comprises at least one of the following: at least a part of a circumference, a spiral line and a polygonal line.

By using a heat exchange assembly for a heat exchanger, a heat exchanger comprising the heat exchange assembly, and a mold for forming the heat exchange assembly according to embodiments of the present invention, for example, product costs can be lowered.

DETAILED DESCRIPTION

Figure 1:
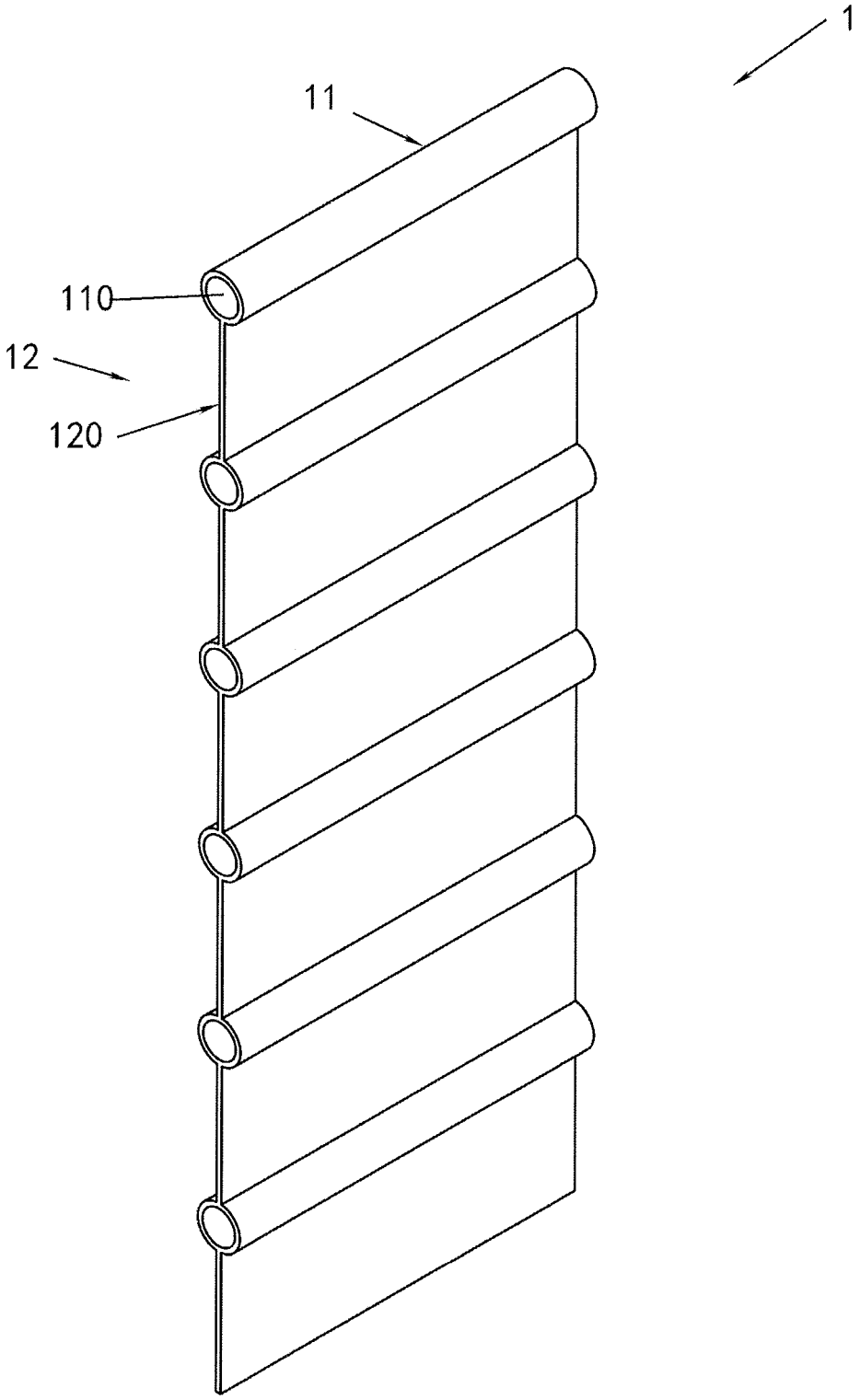
FIG. 1 is a schematic three-dimensional view of a heat exchange assembly for a heat exchanger according to a first embodiment of the present invention.
Figure 2:
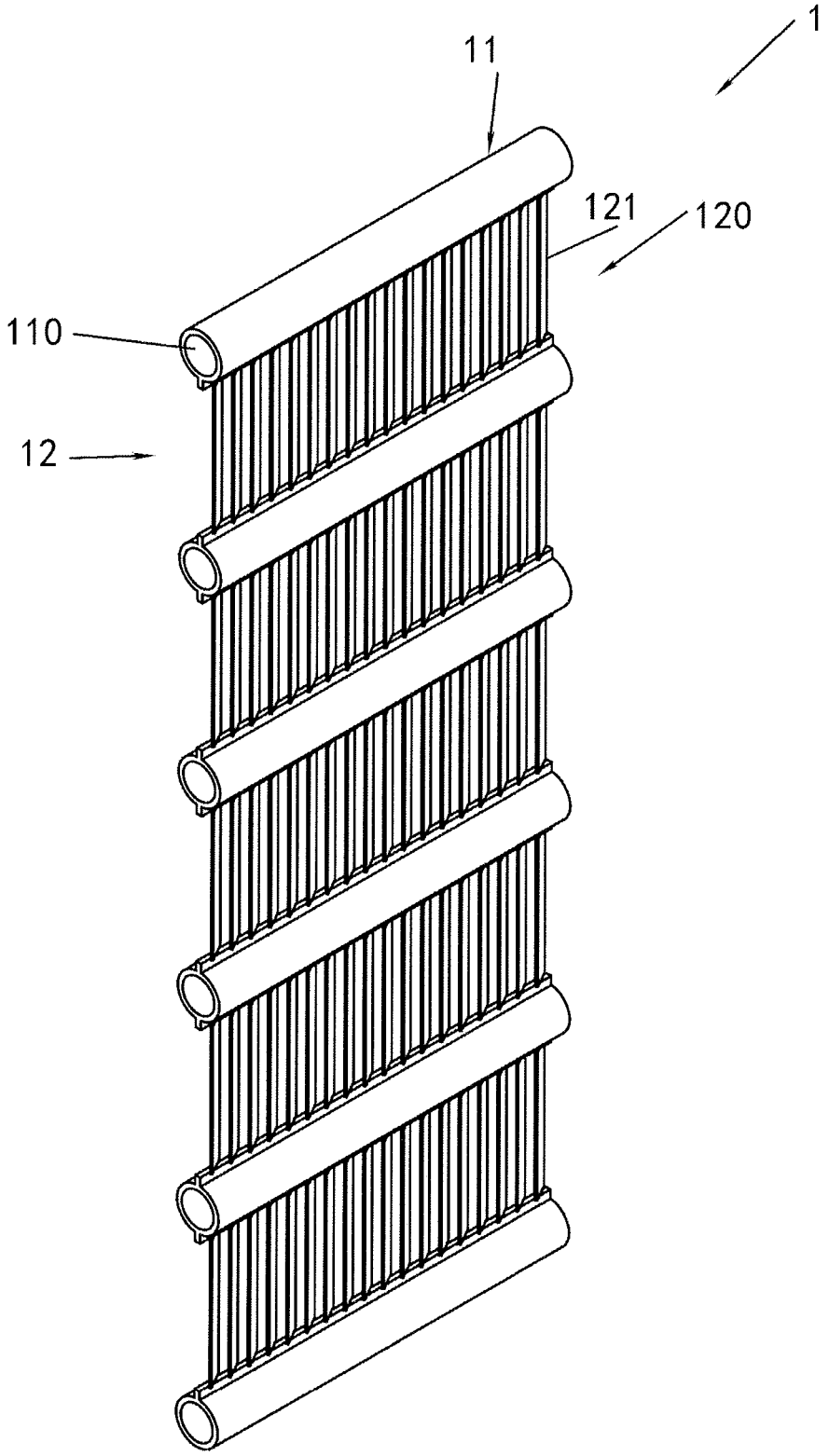
FIG. 2 is a schematic three-dimensional view of a heat exchange assembly for a heat exchanger according to a second embodiment of the present invention.

The present invention is explained further below with reference to the accompanying drawings and particular embodiments.

Referring to FIGS. 1 to 12, a heat exchange assembly 1 for a heat exchanger according to an embodiment of the present invention comprises: multiple heat exchange tubes 11 for a heat exchange medium to flow through; a connecting plate 12 connected between adjacent heat exchange tubes 11; and a heat exchange plate 121 formed by at least a part of the connecting plate 12. The multiple heat exchange tubes 11 and the connecting plate 12 may be formed as a single body by extrusion molding or another method.

Referring to FIGS. 2 to 4, 8, 9 and 12, in embodiments of the present invention, the connecting plate 12 comprises a main body 120, and a heat exchange plate 121 which is not in the same plane as the main body 120. In one example, the heat exchange plate 121 comprises a louver-like heat exchange plate 121. The ratio of a length of the heat exchange plate 121 to a width of the connecting plate 12 is in the range of 0.2-3. In another example, the heat exchange plate 121 comprises a main body 120, and a bridge plate protruding from the main body 120 to one side of the main body 120 in a direction perpendicular to the main body 120, with a part of a periphery of the bridge plate being separate from the main body 120. A length direction of the heat exchange plate 121 may be substantially perpendicular to, or form an acute angle with, an axial direction of the heat exchange tube 11. Although some drawings of heat exchangers and heat exchange assemblies 1 do not show louver-like heat exchange plates 121 and bridge plates, etc., the heat exchangers and heat exchange assemblies 1 shown in these drawings may be provided with heat exchange plates 121 and bridge plates, etc.

Figure 10:
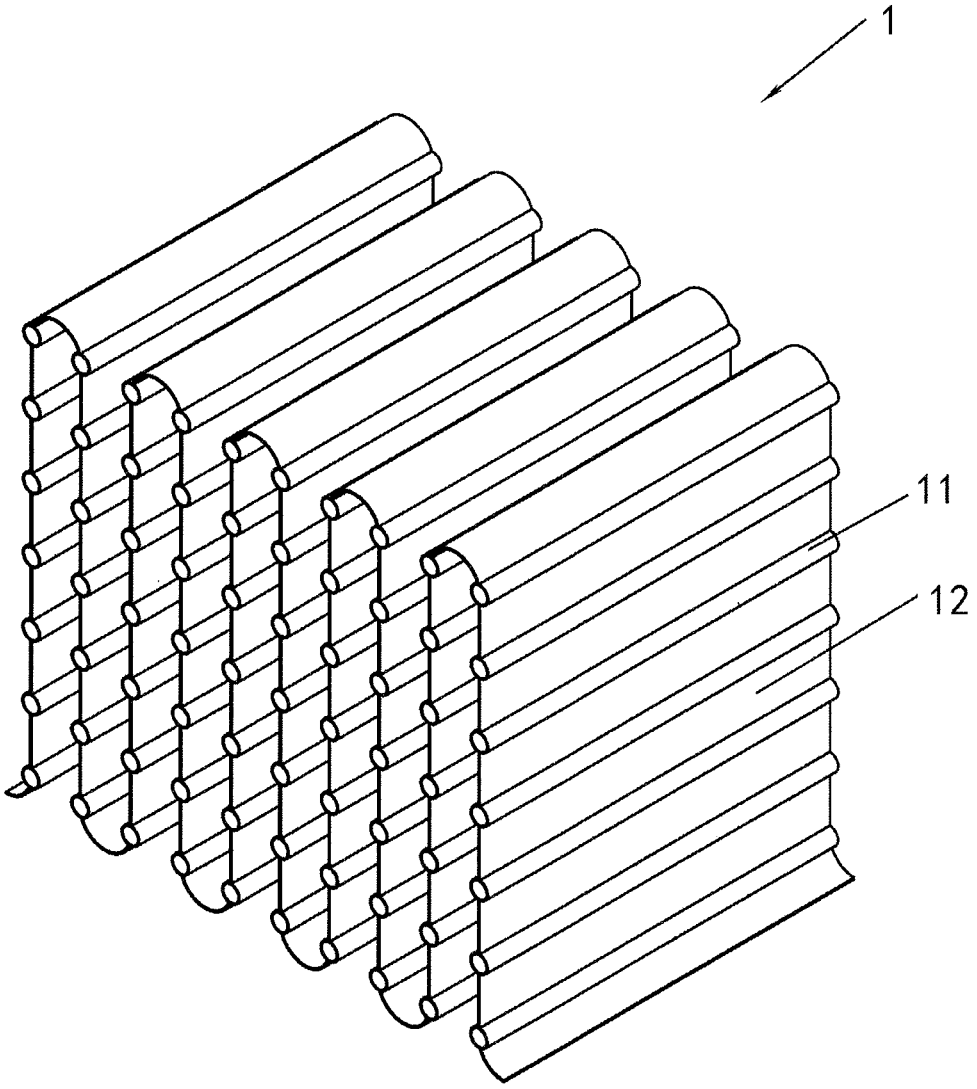
FIG. 10 is a schematic three-dimensional view of one arrangement of a heat exchange assembly of a heat exchanger according to an embodiment of the present invention.
Figure 11:
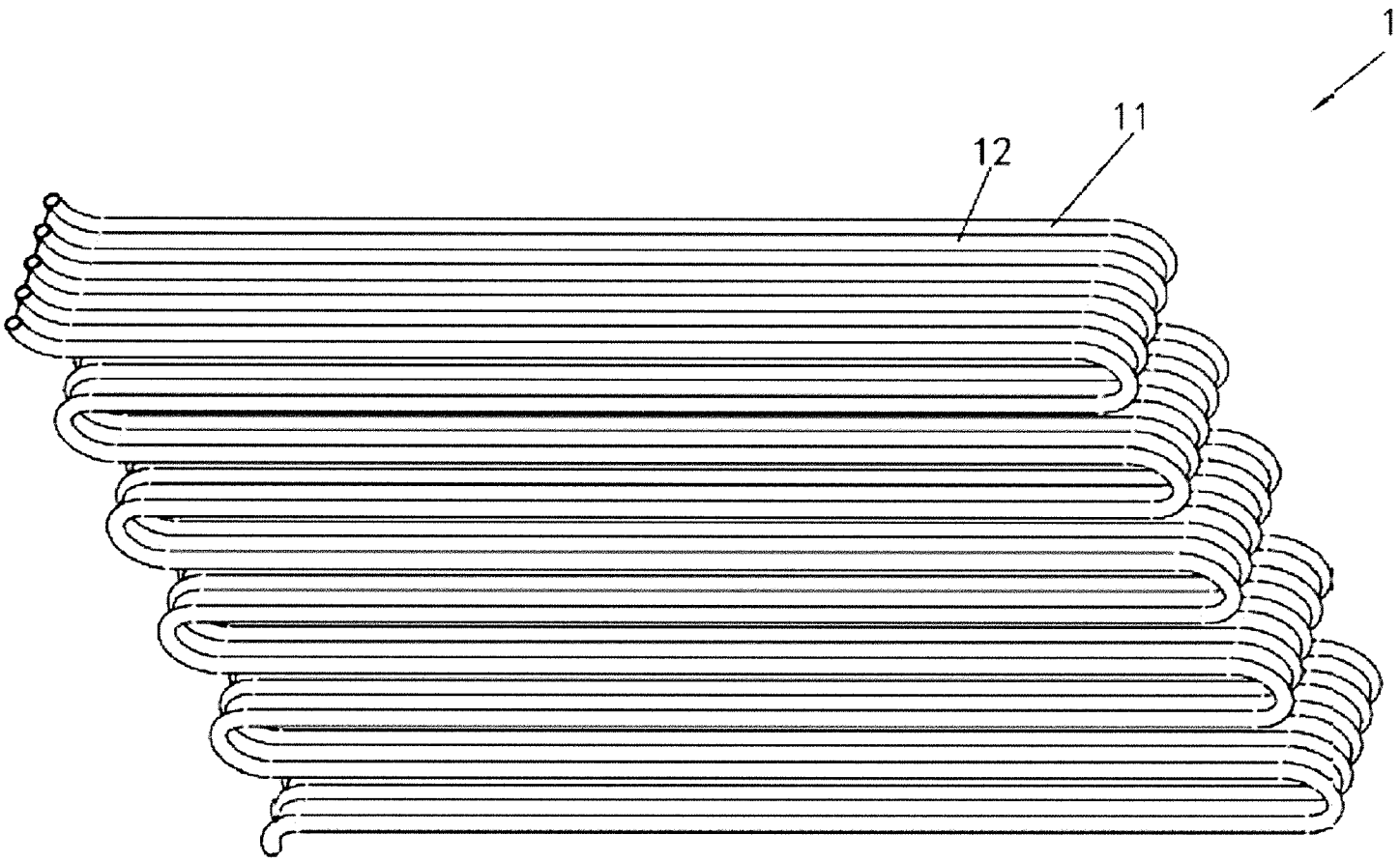
FIG. 11 is a schematic three-dimensional view of another arrangement of a heat exchange assembly of a heat exchanger according to an embodiment of the present invention.

According to an embodiment of the present invention, the connecting plate 12 of the heat exchange assembly 1 undergoes window-opening and forms the louver-like heat exchange plate 121, or the connecting plate 12 undergoes other processing, then multiple layers of the heat exchange assembly 1 are stacked to form multiple layers, or are folded to form multiple layers or form multiple layers in another manner, and two ends of the heat exchange tube are connected to two or more headers 15. As shown in FIGS. 10 and 11, the heat exchange assembly 1 may be folded substantially in a length direction or a width direction.

According to an embodiment of the present invention, the connecting plate 12 of the heat exchange assembly 1 may be formed with slits, etc. Material may be removed from the connecting plate 12. The shape of the removed material may be strip-like, block-like, round, etc.

Figure 3:
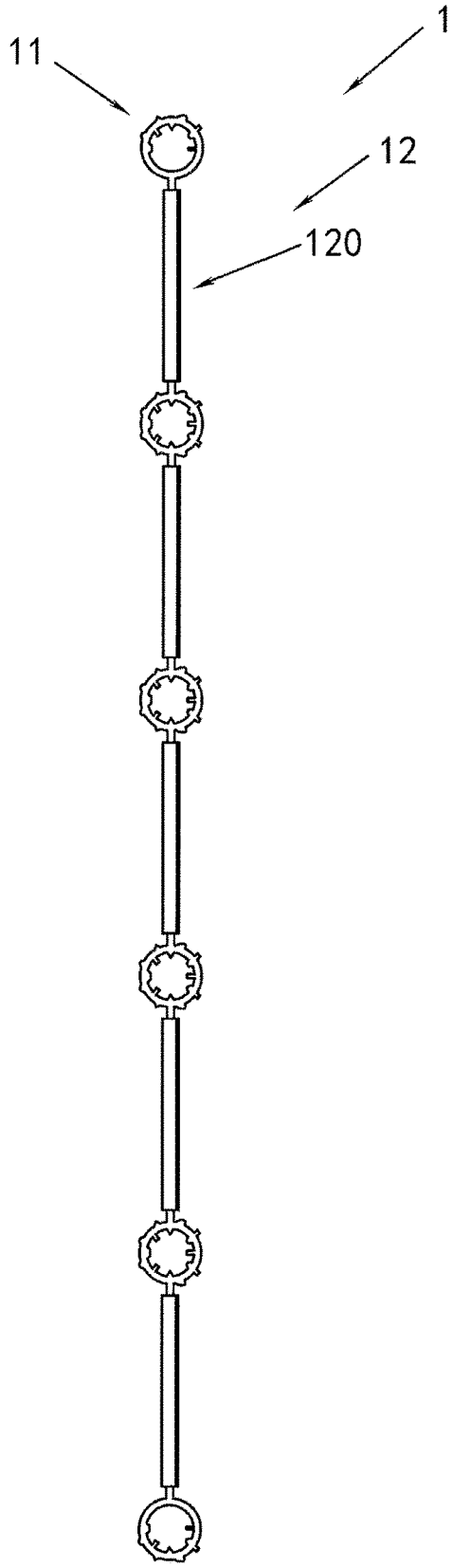
FIG. 3 is a schematic side view of a heat exchange assembly for a heat exchanger according to a third embodiment of the present invention.
Figure 4:
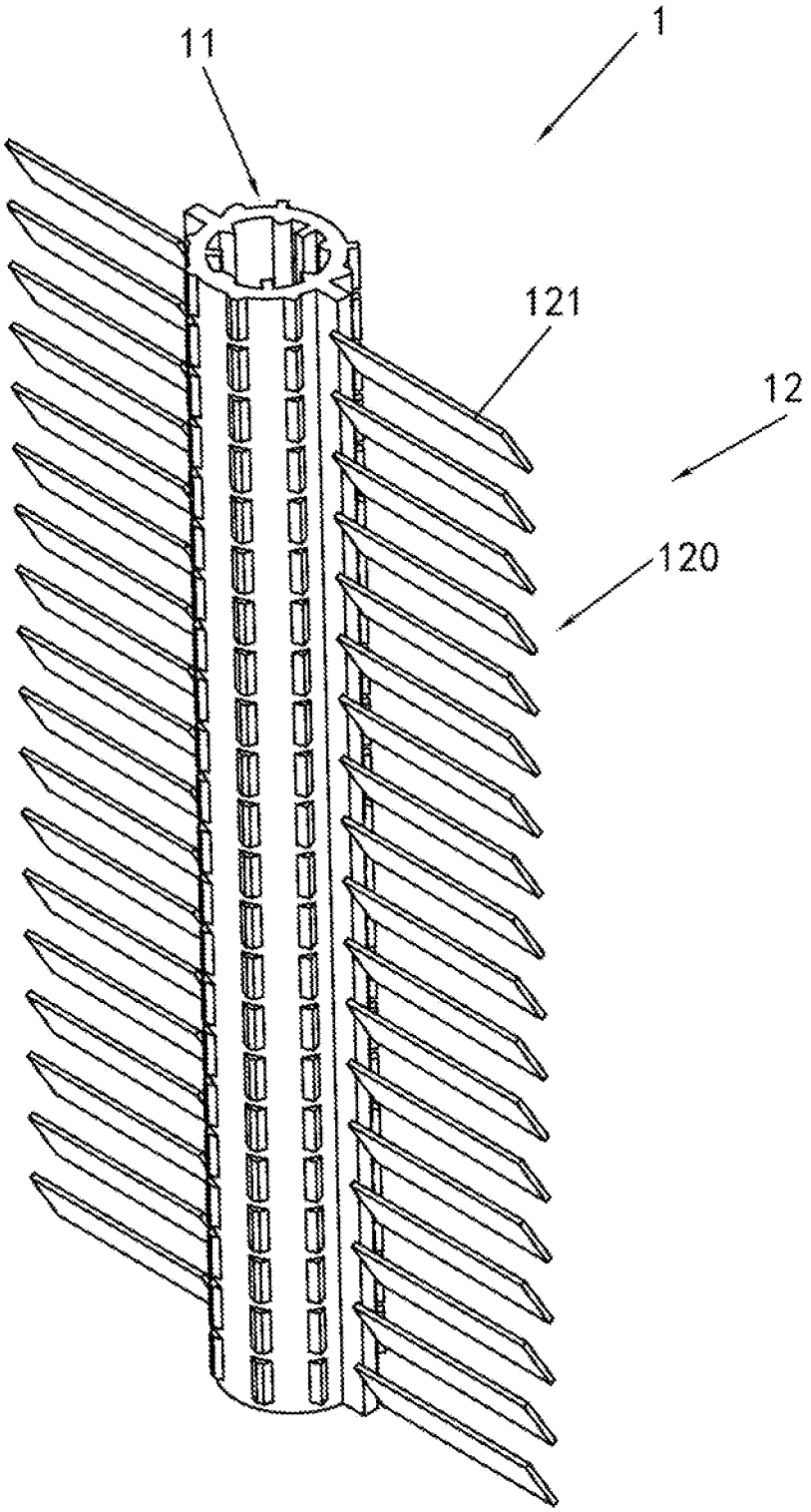
FIG. 4 is a schematic three-dimensional view of the heat exchange assembly for a heat exchanger according to the third embodiment of the present invention.
Figure 5:
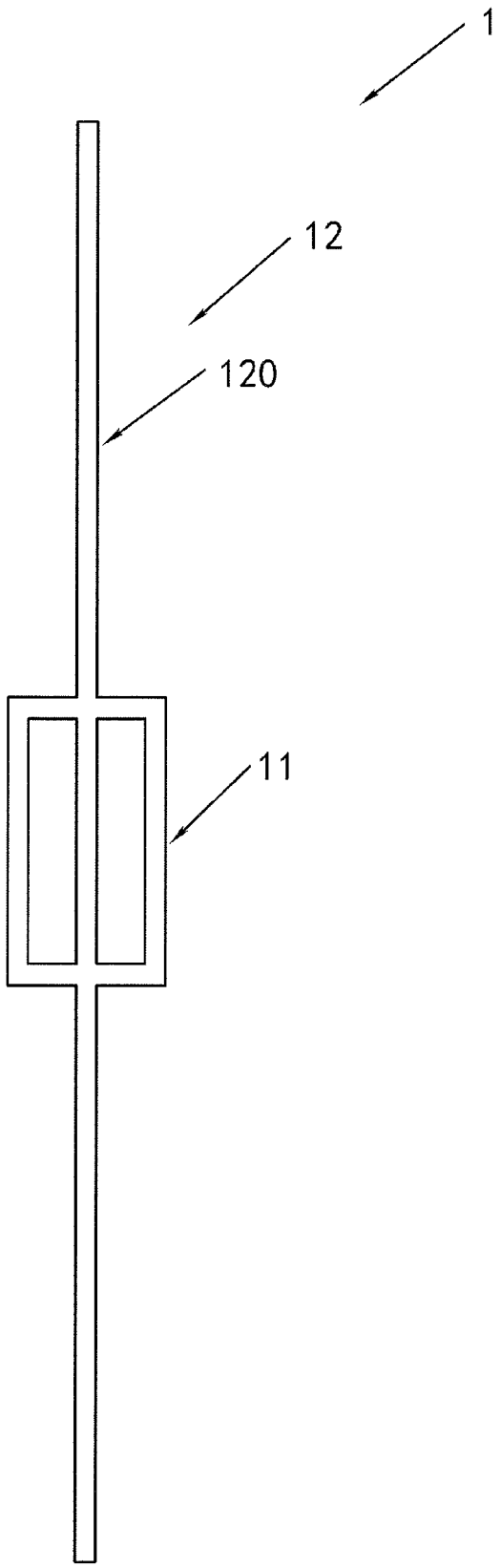
FIG. 5 is a schematic side view of a heat exchange assembly for a heat exchanger according to a fourth embodiment of the present invention.

In an embodiment of the present invention, the heat exchange tube 11 may be round, square, rectangular or another shape. As shown in FIGS. 3 and 4, both an inner side and an outer side of the heat exchange tube 11 may have fins or patterns. As shown in FIG. 5, the heat exchange tube 11 may be a single-channel or a multi-channel heat exchange tube.

Figure 6:
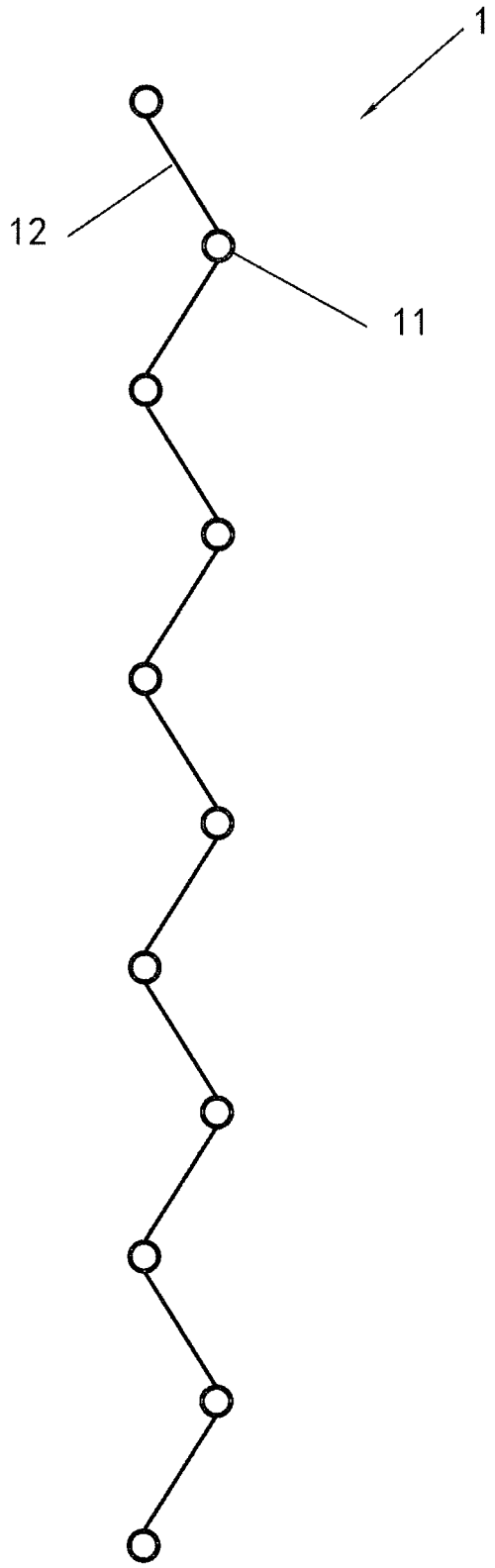
FIG. 6 is a schematic side view of a heat exchange assembly for a heat exchanger according to a fifth embodiment of the present invention.
Figure 7:
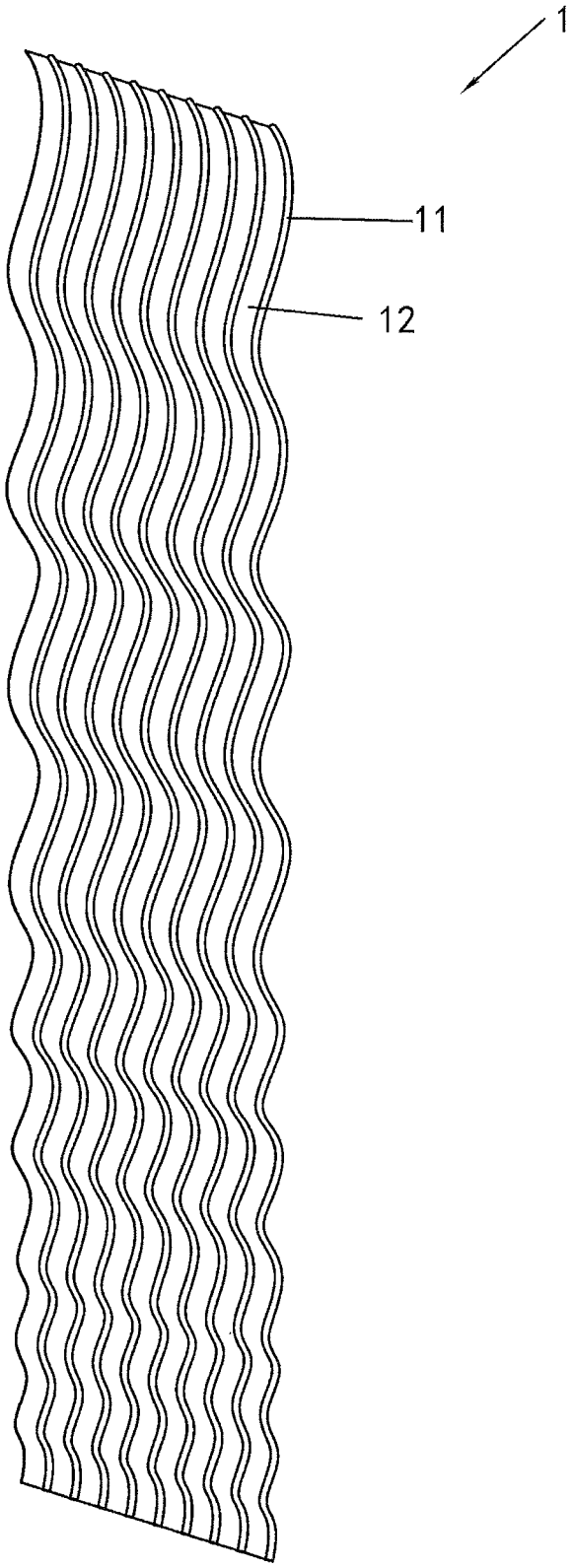
FIG. 7 is a schematic three-dimensional view of a heat exchange assembly for a heat exchanger according to a sixth embodiment of the present invention.

In an embodiment of the present invention, as shown in FIGS. 6 and 7, the heat exchange assembly 1 may be bent or twisted in the axial direction of the heat exchange tube 11 or perpendicular to the axial direction of the heat exchange tube 11, and may also be directly processed into a bent state. For example, the heat exchange assembly 1 has the shape of a polygonal line when viewed in a direction parallel to the axial direction of the heat exchange tube 11; or the heat exchange assembly 1 has a corrugated shape when viewed in a direction perpendicular to the axial direction of the heat exchange tube. The heat exchange area of the heat exchange assembly 1 can thereby be increased.

In an embodiment of the present invention, the sizes, numbers of through-holes and shapes etc. of the heat exchange tubes 11 of the heat exchange assembly 1 may be different, e.g. the diameters and cross-sectional shapes etc. of the heat exchange tubes 11 may be different. The sizes and shapes of the connecting plates 12 between the heat exchange tubes 11 may be different, e.g. the thicknesses and lengths etc. of the connecting plates 12 may be different. The structures etc. of window-openings on the connecting plates 12 (louver-like heat exchange plates) may be different, e.g. the lengths, angles and separations etc. of window-openings (louver-like heat exchange plates) may be different. The hydraulic diameter range of the heat exchange tube 11 may be 0.1-5 mm. The thickness range of the connecting plate 12 may be 0.02-1 mm, and the range of width (the distance between two adjacent heat exchange tubes 11) of the connecting plate 12 may be 3-30 mm.

A heat exchanger according to an embodiment of the present invention is described below.

Figure 8:
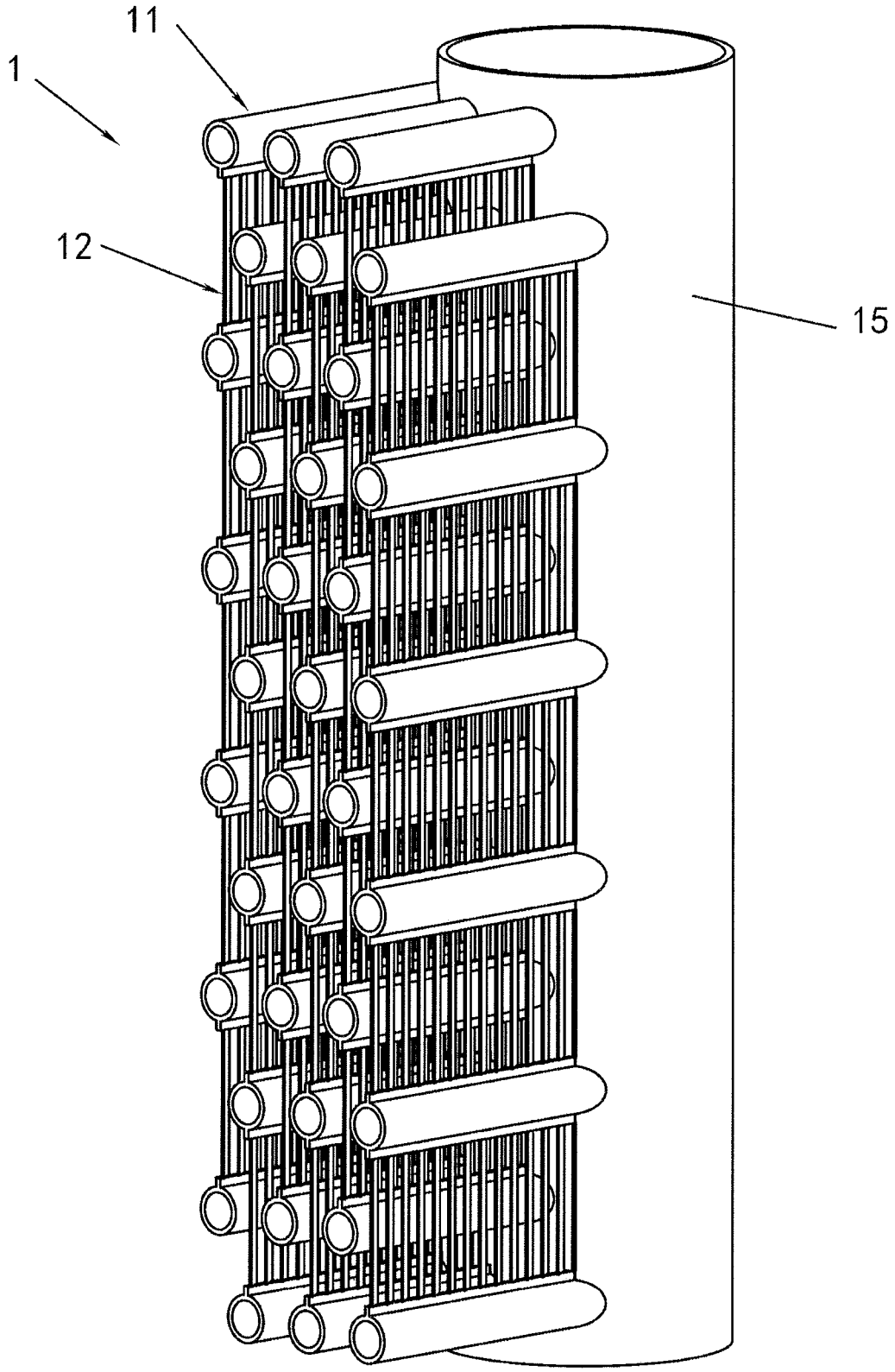
FIG. 8 is a schematic three-dimensional view of a heat exchanger according to a first embodiment of the present invention.
Figure 9:
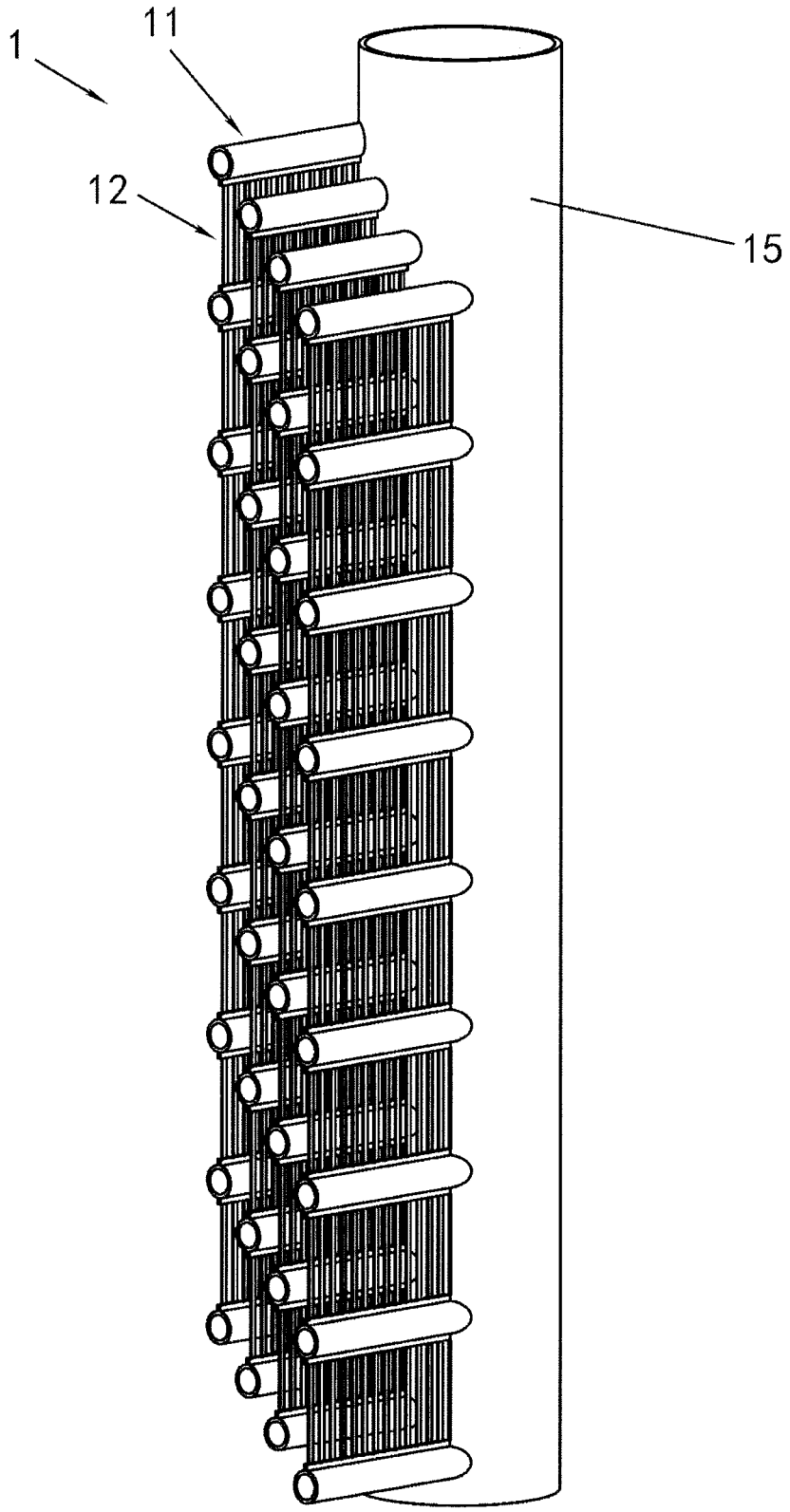
FIG. 9 is a schematic three-dimensional view of a heat exchanger according to a second embodiment of the present invention.
Figure 12:
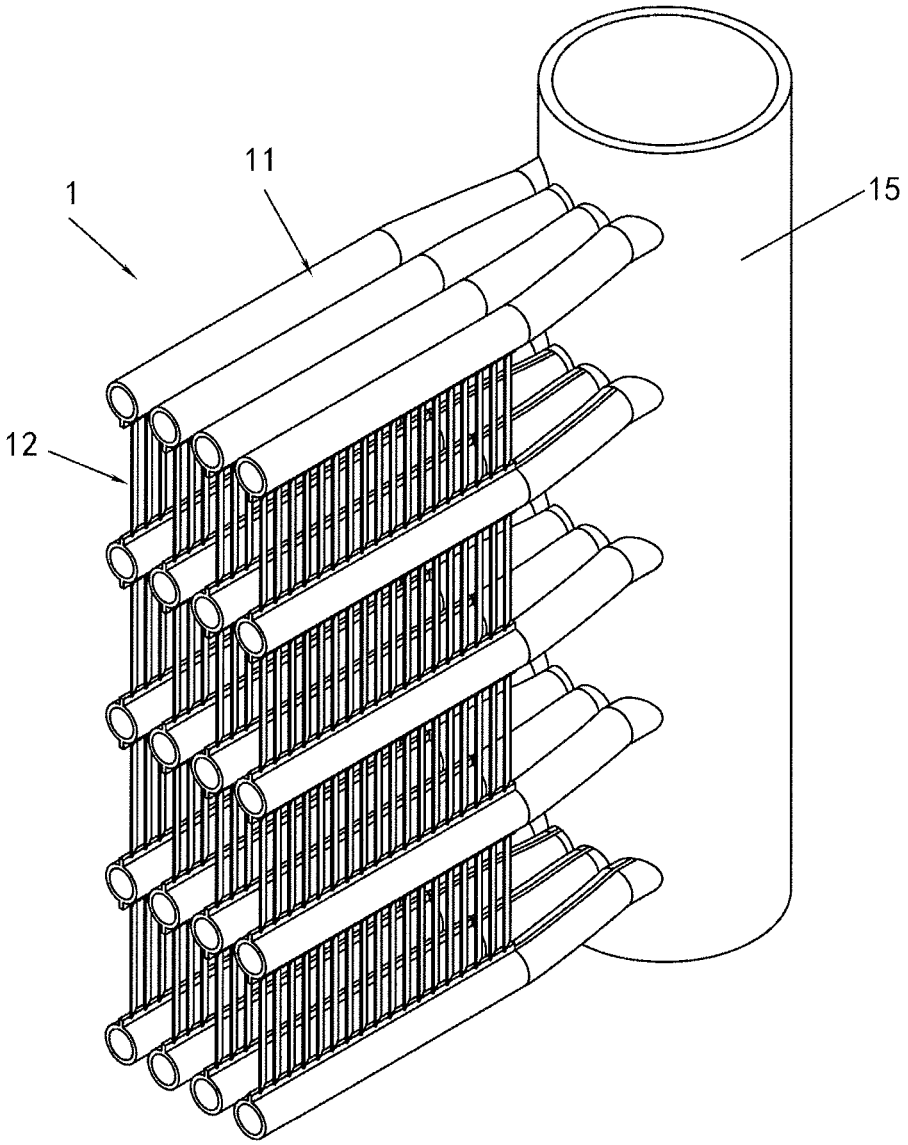
FIG. 12 is a schematic three-dimensional view of a heat exchanger according to a third embodiment of the present invention.
Figure 13:
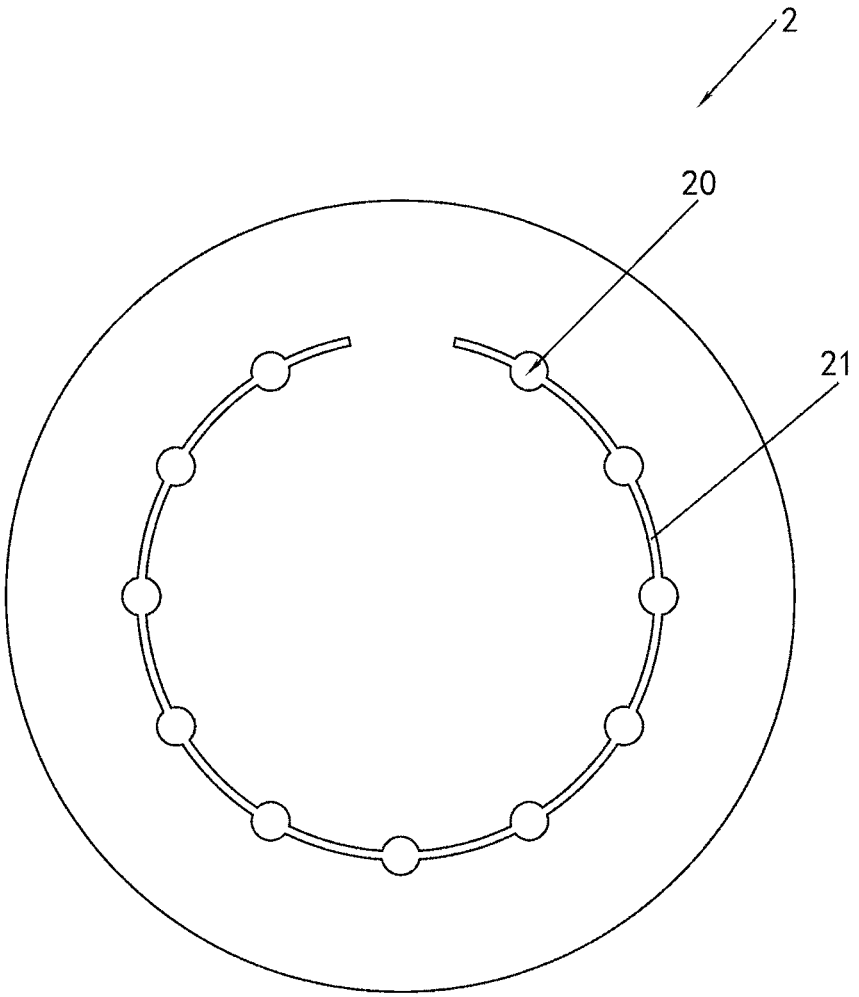
FIG. 13 is a schematic main view of a mold according to a first embodiment of the present invention.
Figure 14:
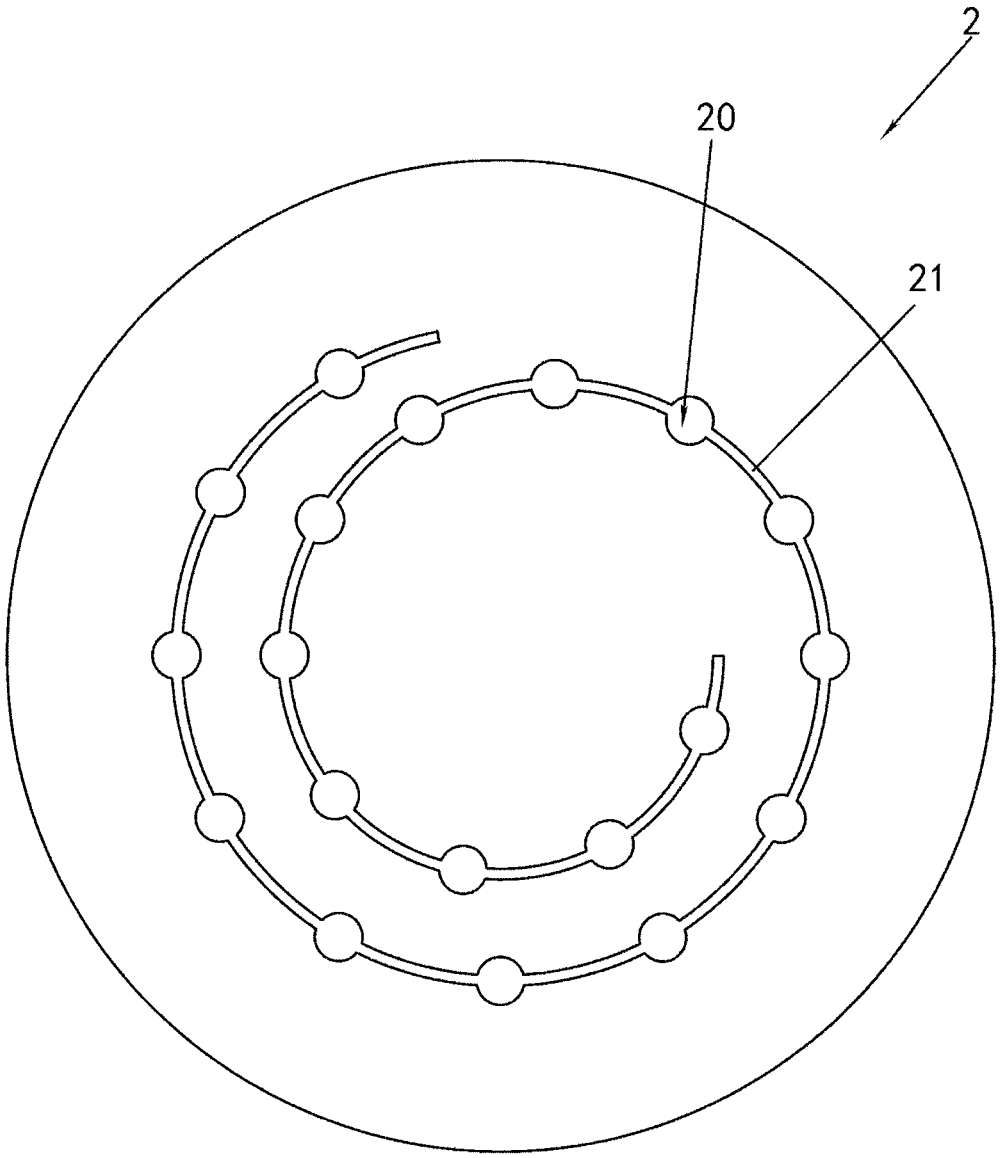
FIG. 14 is a schematic main view of a mold according to a second embodiment of the present invention.
Figure 15:
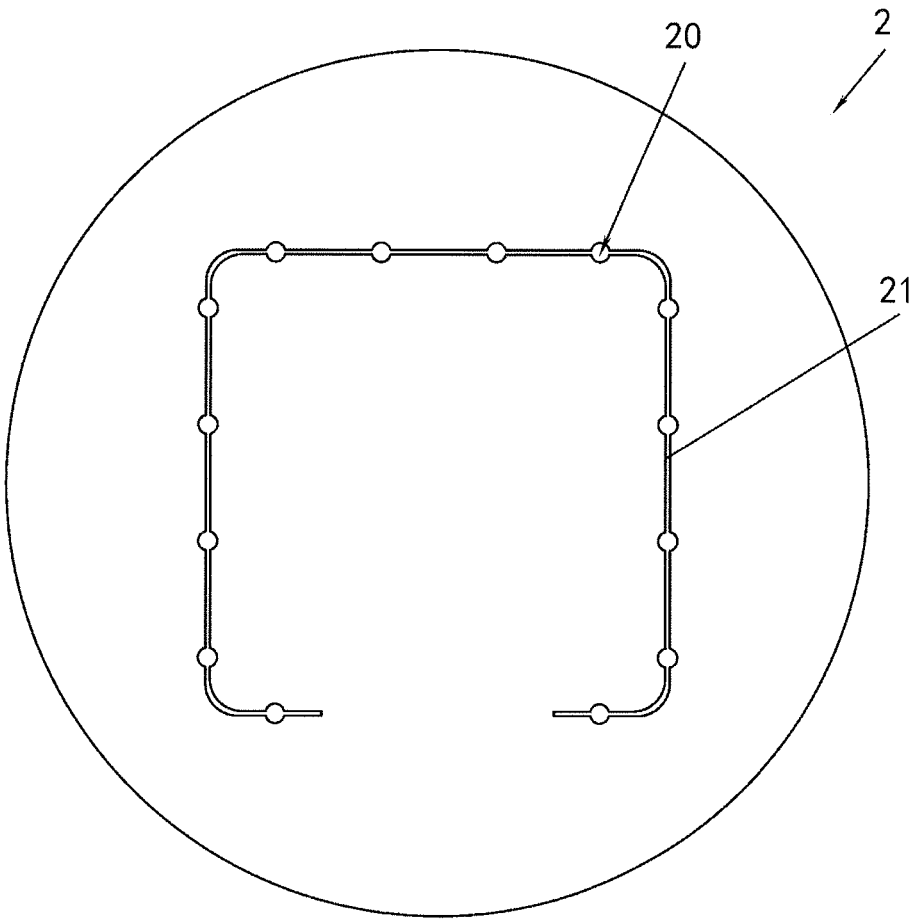
FIG. 15 is a schematic main view of a mold according to a third embodiment of the present invention.
Figure 16:
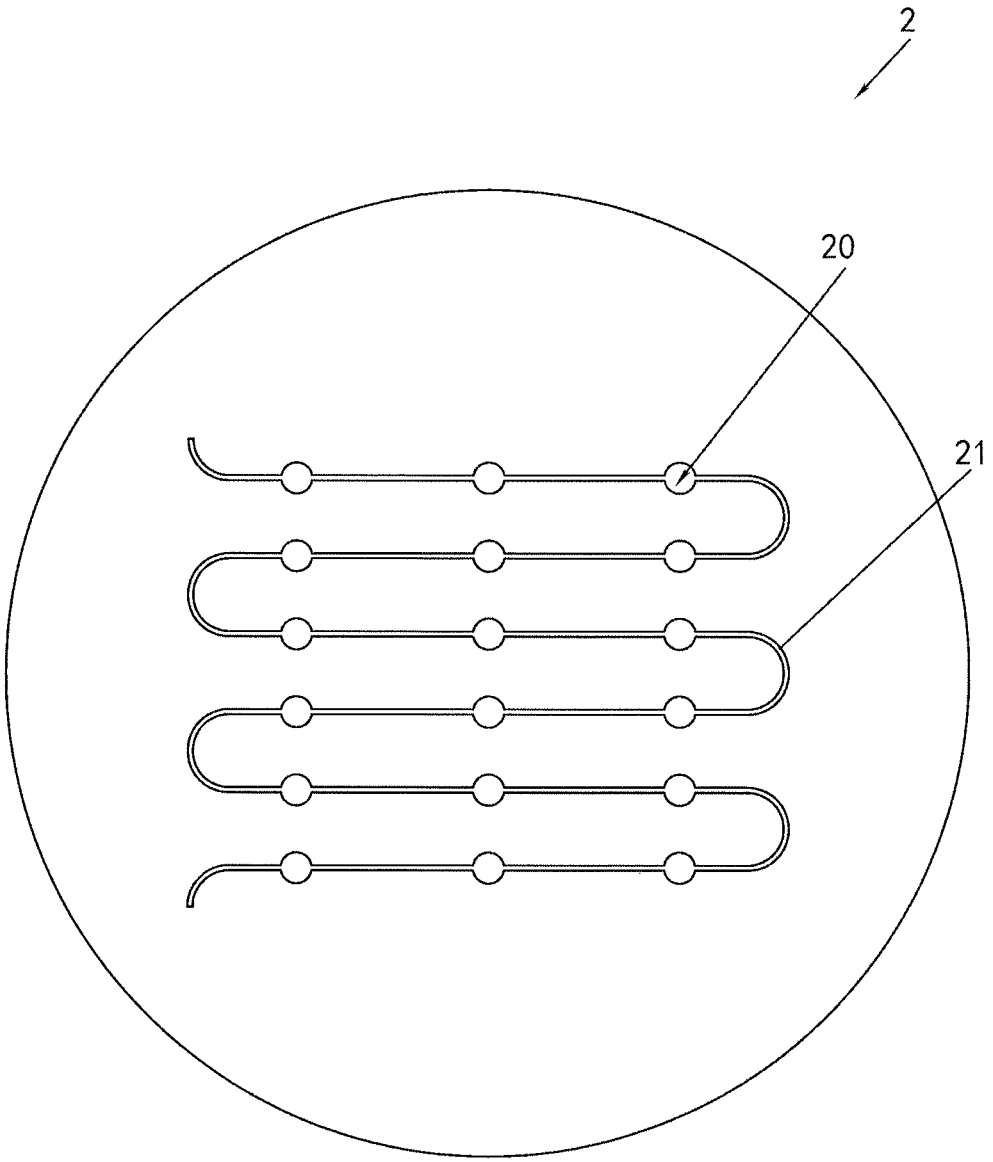
FIG. 16 is a schematic main view of a mold according to a fourth embodiment of the present invention.

Referring to FIGS. 8 to 12, a heat exchanger according to an embodiment of the present invention comprises a heat exchange assembly 1. Referring to FIGS. 8, 9 and 12, the heat exchanger further comprises a header 15; the heat exchange assembly 1 is at least one layer of the heat exchange assembly 1 which is substantially parallel to an axial direction of the header 15, or a multiple-layer heat exchange assembly 1; each layer of the heat exchange assembly 1 in the multiple-layer heat exchange assembly 1 is substantially parallel to the axial direction of the header 15. The multiple-layer heat exchange assembly 1 may be formed by bending a single heat exchange assembly 1. As shown in FIGS. 10 and 11, the multiple-layer heat exchange assembly 1 may be formed by bending a single heat exchange assembly in a direction substantially parallel or perpendicular to the axial direction of the heat exchange tube 11.

As shown in FIGS. 6 and 7, in an embodiment of the present invention, the heat exchange assembly 1 has the shape of a polygonal line when viewed in a direction parallel to the axial direction of the heat exchange tube 11; or the heat exchange assembly 1 has a corrugated shape when viewed in a direction perpendicular to the axial direction of the heat exchange tube. The heat exchange area of the heat exchange assembly 1 can thereby be increased.

Referring to FIGS. 8 and 9, in embodiments of the present invention, ends of multiple heat exchange tubes 11 in the multiple-layer heat exchange assembly 1 are respectively inserted into different openings of the header 15. Referring to FIG. 12, ends of multiple heat exchange tubes 11 in the multiple-layer heat exchange assembly 1, which are arranged in a direction substantially perpendicular to or forming an acute angle with the axial direction of the header 15, are inserted into the same opening of the header 15. For example, ends of multiple heat exchange tubes 11 in the multiple-layer heat exchange assembly 1, which are located in the same position in the axial direction of the header 15, are inserted into the same opening of the header 15.

In an embodiment of the present invention, in some application scenarios, a wind direction is substantially perpendicular to a plane in which the connecting plate 12 or the main body 120 of the connecting plate 12 lies.

In an embodiment of the present invention, the heat exchanger may comprise a single-layer heat exchange assembly 1 or a multiple-layer heat exchange assembly 1. The heat exchanger may be bent along the heat exchange tubes 11, to form multiple bent parts. Referring to FIGS. 8 to 12, various independent heat exchange assemblies 1 may be stacked to form multiple layers. Referring to FIGS. 8 and 12, the heat exchange assemblies 1 in each of the layers may be stacked in an aligned manner. When the heat exchange assemblies 1 in each of the layers are placed perpendicularly, the axes of the corresponding heat exchange tubes 11 in each of the layers lie in the same horizontal plane. The various independent heat exchange assemblies 1 may be used in a stacked manner. Referring to FIG. 9, the multiple-layer heat exchange assembly 1 may also be stacked in an alternating manner. For example, heat exchange tubes 11 of at least two layers of the heat exchange assembly 1 in the heat exchange assembly 1 are staggered with respect to each other in a direction perpendicular to the axial direction of the heat exchange tubes 11, in order to increase the contact of the heat exchange tubes 11 with air and promote air turbulence, thereby increasing the heat exchange efficiency of the heat exchanger. When the heat exchange assemblies 1 in each of the layers are placed perpendicularly, the axes of the heat exchange tubes 11 in each of the layers lie in different horizontal planes.

In embodiments of the present invention, referring to FIGS. 10 to 11, one independent heat exchange assembly 1 can be folded or bent into multiple layers for use. As shown in FIG. 10, when folding is carried out, the heat exchange tubes 11 may be kept unchanged, and the lengths of each of the layers of heat exchange assembly 1 may be the same or different. As shown in FIG. 11, the heat exchange assembly 1 may be bent along the heat exchange tubes 11, to form multiple bent parts; multiple heat exchange tubes 11 at two ends of the heat exchange assembly 1 may be arranged substantially in the axial directions of the headers and inserted into the headers. The heat exchange tubes 11 on two adjacent layers of the heat exchange assembly 1 may be aligned or staggered. In some application scenarios, wind may blow in an up-down direction or a front-rear direction; the wind direction is substantially perpendicular or parallel to a plane in which the connecting plate 12 or the main body 120 of the connecting plate 12 lies.

In embodiments of the present invention, in the case where a multiple-layer heat exchange assembly 1 is used, each layer of the heat exchange assembly 1 may have a different structure, and the distances between different layers of heat exchange assembly 1, the numbers of heat exchange tubes on different layers of the heat exchange assembly 1, the tube diameters, the dimensions of the connecting plates etc., and the window-openings on the connecting plates (louver-like heat exchange plates), etc. may all be different. The relationship between the distance (LD) between two adjacent layers of the heat exchange assembly 1 and the separation (LP) of window-openings on the connecting plates 12 (louver-like heat exchange plates) is: $0.2LP \leq LD \leq 10LP$; the relationship between the distance (LD) between two adjacent layers of the heat exchange assembly 1 and the hydraulic diameter (HD) of the heat exchange tubes is: $0.2HD \leq LD \leq 10HD$.

In embodiments of the present invention, referring to as 8, 9 and 12, two ends of the heat exchange tube may be connected to a single header or multiple headers. As shown in FIGS. 8 and 9, each heat exchange tube may be inserted into the header individually, or as shown in FIG. 12, multiple heat exchange tubes are placed together side by side, and then inserted into the header.

A mold according to an embodiment of the present invention for forming a heat exchange assembly 1 is described below.

Referring to FIGS. 13 to 16, the mold comprises: a first mold, being used to form holes 110 of multiple heat exchange tubes 11 (see FIGS. 1 and 2); and a second mold 2, the second mold 2 having a mold cavity 20 for forming a main body of the heat exchange assembly 1, the mold cavity 20 having an opening 21, and the heat exchange assembly 1 being extruded from the opening 21 of the mold cavity 20 of the second mold 2. The opening 21 is belt-like, and extends along a curved line. The curved line may be a non-closed line or a closed line. For example, the curved line may comprise at least one of the following: at least a part of a circumference, a spiral line, a polygonal line and a zigzag line.

As shown in FIGS. 13 to 16, the cross section of the extruded heat exchange assembly in a direction perpendicular to the axis of the heat exchange tube is non-linear, and may be in the shape of a non-closed curved line, e.g. a part of a circle, a spiral, or a part of a polygon, or zigzag-shaped. The extruded heat exchange assembly may form a linear shape by being opened out, etc. Using the method, a mold of small dimensions can also produce a product of large dimensions.

Through the use of the heat exchange assembly for a heat exchanger according to an embodiment of the present invention, and the heat exchanger comprising the heat exchange assembly, it is possible to increase the heat exchange efficiency, reduce product costs, increase the water drainage speed, extend the frost removal period, and reduce the refrigerant filling amount, and the product is easy to recycle.

In the heat exchanger comprising the heat exchange assembly in an embodiment of the present invention, the heat exchange assembly may be arranged horizontally or vertically, and has a good water drainage effect in both cases.

Although the above embodiments have been described, some features in the above embodiments may be combined to form new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A heat exchange assembly for a heat exchanger, the heat exchange assembly comprising:

a plurality of heat exchange tubes for a heat exchange medium to flow through; and a connecting plate connected between adjacent heat exchange tubes;

wherein at least a part of the connecting plate constitutes a heat exchange plate; and wherein the connecting plate extends along each adjacent heat exchange tube in a length direction of the heat exchange tube.

2. The heat exchange assembly for a heat exchanger as claimed in claim 1, wherein:

the connecting plate comprises a main body, and wherein the heat exchange plate lies in a different plane than a plane in which the main body lies.

3. The heat exchange assembly for a heat exchanger as claimed in claim 1, wherein:

the heat exchange plate comprises a louver-like heat exchange plate.

4. The heat exchange assembly for a heat exchanger as claimed in claim 1, wherein:

the heat exchange plate comprises a main body, and a bridge plate protruding from the main body to one side of the main body in a direction perpendicular to the main body, with a part of a periphery of the bridge plate being separate from the main body.

5. The heat exchange assembly for a heat exchanger as claimed in claim 1, wherein:

a length direction of the heat exchange plate is substantially perpendicular to, or forms an angle other than perpendicular with, an axial direction of the heat exchange tube.

6. The heat exchange assembly for a heat exchanger as claimed in claim 1, wherein:

the plurality of heat exchange tubes and the connecting plate are formed as a single body by extrusion molding.

7. A heat exchanger, comprising:

the heat exchange assembly for a heat exchanger as claimed in claim 1.

8. The heat exchanger as claimed in claim 7, further comprising:

a header, the heat exchange assembly being one layer and substantially parallel to an axial direction of the header.

9. The heat exchanger as claimed in claim 7, wherein:

the heat exchange assembly is a multiple-layer heat exchange assembly formed by bending a single heat exchange assembly.

10. The heat exchanger as claimed in claim 9, wherein:

the multiple-layer heat exchange assembly is formed by bending a single heat exchange assembly in a direction substantially parallel or perpendicular to an axial direction of the heat exchange tube.

11. The heat exchanger as claimed in claim 7, wherein:

the heat exchange assembly is a multiple-layer heat exchange assembly, and ends of multiple heat exchange tubes in the multiple-layer heat exchange assembly are respectively inserted into different openings of a header.

12. The heat exchanger as claimed in claim 7, wherein:

the heat exchange assembly has the shape of a polygonal line when viewed in a direction parallel to an axial direction of the heat exchange tube.

13. The heat exchanger as claimed in claim 7, wherein:

the heat exchange assembly has a corrugated shape when viewed in a direction perpendicular to an axial direction of the heat exchange tube.

14. The heat exchanger as claimed in claim 7, wherein:

the heat exchange assembly is a multiple-layer heat exchange assembly, and heat exchange tubes of at least two layers of the heat exchange assembly in the heat exchange assembly are staggered with respect to each other in a direction perpendicular to an axial direction of the heat exchange tubes.

15. The heat exchanger as claimed in claim 7, wherein:

the heat exchange assembly is a multiple-layer heat exchange assembly, and ends of multiple heat exchange tubes in the multiple-layer heat exchange assembly, which are arranged in a direction substantially perpendicular to or forming an acute angle with an axial direction of a header, are inserted into the same opening of the header.

16. A mold for forming the heat exchange assembly for a heat exchanger as claimed in claim 1, the mold comprising:

a first mold, being used to form holes of multiple heat exchange tubes; and a second mold, the second mold having a mold cavity for forming a main body of the heat exchange assembly, the mold cavity having an opening, and the heat exchange assembly being extruded from the opening of the mold cavity of the second mold, wherein the opening is belt-like, and extends along a curved line.

17. The mold as claimed in claim 16, wherein:

the curved line is a non-closed line.

18. The mold as claimed in claim 16, wherein:

the curved line comprises at least one of the following: at least a part of a circumference, a spiral line and a polygonal line.

* * * * *